US006691803B2

(12) United States Patent
Nackerud

(10) Patent No.: US 6,691,803 B2
(45) **Date of Patent: *Feb. 17, 2004**

(54) DRILL BIT ASSEMBLY HAVING PIVOTAL CUTTER BLADES

(76) Inventor: Alan L. Nackerud, 9957 Titan Park Cir., Littleton, CO (US) 80125

( * ) Notice: Subject to any disclaimer, the term of this patent is extended or adjusted under 35 U.S.C. 154(b) by 30 days.

This patent is subject to a terminal disclaimer.

(21) Appl. No.: 09/962,365

(22) Filed: Sep. 25, 2001

(65) Prior Publication Data

US 2002/0050409 A1 May 2, 2002

Related U.S. Application Data

(63) Continuation-in-part of application No. 09/699,172, filed on Oct. 27, 2000.

(51) Int. Cl.[7] ..... E21B 10/66

(52) U.S. Cl. ..... 175/57; 175/259; 175/265; 175/292

(58) Field of Search ..... 175/57, 258, 259, 175/263, 265, 267, 292

(56) References Cited

U.S. PATENT DOCUMENTS

| | | | | |
|---|---|---|---|---|
| 2,203,998 A | | 6/1940 | O'Grady | |
| 2,814,463 A | | 11/1957 | Kammerer, Jr. | |
| 3,196,961 A | | 7/1965 | Kammerer | |
| 3,552,509 A | | 1/1971 | Brown | |
| 3,554,304 A | | 1/1971 | Link | |
| 3,656,564 A | | 4/1972 | Brown | |
| 3,684,041 A | | 8/1972 | Kammerer | |
| 5,271,472 A | | 12/1993 | Leturno | |
| 5,385,205 A | * | 1/1995 | Hailey | 175/267 |
| 6,454,024 B1 | * | 9/2002 | Nackerud | 175/57 |

* cited by examiner

*Primary Examiner*—William Neuder
(74) *Attorney, Agent, or Firm*—John E. Reilly

(57) ABSTRACT

A drill bit assembly for earth boring operations in which a sub is connected to a lower end of a drill string and elongated cutter blades are pivotally secured to a lower end of the body which have cutter elements preferably in the form of rotatable cutter disks along their leading edges and a fluid delivery hose leads into fluid passages in each of the cutter blades to supply fluid under pressure to a series of fluid discharge nozzles associated with the cutter disks.

29 Claims, 8 Drawing Sheets

DRILL BIT ASSEMBLY HAVING PIVOTAL CUTTER BLADES

CROSS-REFERENCE TO RELATED APPLICATION

This application is a continuation-in-part of patent application Ser. No. 09/699,172, filed Oct. 27, 2000 for REPLACEABLE DRILL BIT ASSEMBLY by Alan L. Nackerud.

BACKGROUND AND FIELD OF INVENTION

This invention relates to rotary drill bits and more particularly relates to a novel and improved drill bit assembly of the type having pivotal cutter blades mounted at the lower end of a conventional drill string.

There is a need for a drill bit assembly which can be mounted at the lower end of a drill string in a conventional manner and is capable of carrying out high speed earth boring operations with or without fluid assist, with or without tungsten carbide buttons, cutting teeth, cutting rollers or polycrystalline and diamond inserts. Most desirably, the drill bit assembly of the present invention incorporates a unique combination and arrangement of cutters and fluid passages along one or more pivotal blade arms of a drill bit assembly.

Representative patents are U.S. Pat. No. 2,203,998 to D. J. O'Grady, U.S. Pat. No. 2,814,463 to A. W. Kammerer, Jr., U.S. Pat. No. 3,196,961 to A. W. Kammerer, U.S. Pat. No. 3,552,509 to C. C. Brown, U.S. Pat. No. 3,554,304 to H. D. Link et al, U.S. Pat. No. 3,656,564 to C. C. Brown, U.S. Pat. No. 3,684,041 to A. W. Kammerer et al and U.S. Pat. No. 5,271,472 to R. E. Leturno.

SUMMARY OF THE INVENTION

It is an object of this invention to provide for a novel and improved drill bit for earth boring operations which is highly versatile and efficient and durable in use.

Another object of the present invention is to provide for a novel and improved drill bit assembly adapted to be mounted on a conventional drill string and which employs a combination of cutter elements and jet discharge nozzles selectively positioned along the length of one or more cutter blades to achieve a uniform cutting force along the length of each blade.

A further object of the present invention is to provide for a novel and improved drill bit assembly which employs a unique combination of cutting inserts and fluid passages to carry out downhole cutting operations and specifically wherein the cutting elements may be employed alone or in combination with fluid pressure to perform different cutting and kerfing operations.

It is a still further object of the present invention to provide for a novel and improved drill bit made up of pivotal cutter blades which employ a unique combination of cutter elements and fluid passages selectively oriented and spaced along the cutting edge of each blade to maximize cutting performance and speed.

In accordance with the present invention, a drill bit assembly is adapted to be mounted on a drill string for performing earth boring operations in a subsurface formation comprising a sub connected to a lower end of the drill string, and a plurality of elongated cutter blades are pivotally secured to a lower end of the sub, the lower end of the sub including cutting elements thereon. The blades include radially inner and outer offset portions along a surface of each blade adapted to move into engagement with the formation, each of the offset portions including cutting members thereon. Fluid delivery means communicates with a fluid circulation bore in each blade for delivery of fluid under pressure through a plurality of fluid discharge ports.

In a preferred form, the cutter elements include a plurality of rotatable cutter disks which are disposed at radially spaced intervals along the length of each cutter blade, each disk oriented for rotation about an axis on the radius of curvature of the circular path of travel traced by each respective disk; and each cutting blade has offset cutting edges defined by radially spaced smaller cutter disks and larger cutter disks, respectively. In addition, an increased number of jet discharge nozzles is provided along the outer offset edge relative to those provided along the inner offset edge as a result of the greater area traversed by the outer edge. Still further, the nozzle locations are staggered with respect to the cutting element locations so that the cutting elements break up the material between the kerf lines formed by the nozzles. For example, if the nozzles are disposed only along one of the blades 17 or 18 and the cutting elements disposed along the other of the blades, the cutting elements will break up that formation material between the kerf lines $L_1$ and $L_2$ formed by the nozzles on the one cutting blade. If the cutting elements are positioned on both blades, they are preferably staggered with respect to one another so as to engage different radial distances in the formation between the kerf lines $L_1$ and $L_2$. Correspondingly, if the nozzles are positioned along both blades, they are offset with respect to one another to form kerf lines $L_1$ and $L_2$ at different radial distances and thereby achieve enhanced cutting action. The number and spacing of cutting elements and nozzles along the offset edges 30 and 32 will of course vary with the hardness of material being drilled, hole size and velocity of the fluid discharge.

The preferred method of drilling into a subsurface formation in accordance with the present invention comprises the steps of discharging a high velocity stream of fluid through a plurality of nozzles in at least one of a pair of rotating drill bits or blades wherein a series of kerf lines are formed in concentric circles, placing a series of cutter elements on at least one other of the blades to break up the formation material between the kerf lines formed by the jet streams through the nozzles and orienting the elements to follow or track the kerf lines formed by the nozzles to assist in breaking up the rock or other material between the kerf lines.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. In this regard, the term "drill string" is employed herein to interchangeably refer to a string of drill pipe(s) or casing(s) or tubing(s). As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENT

Figure 1:
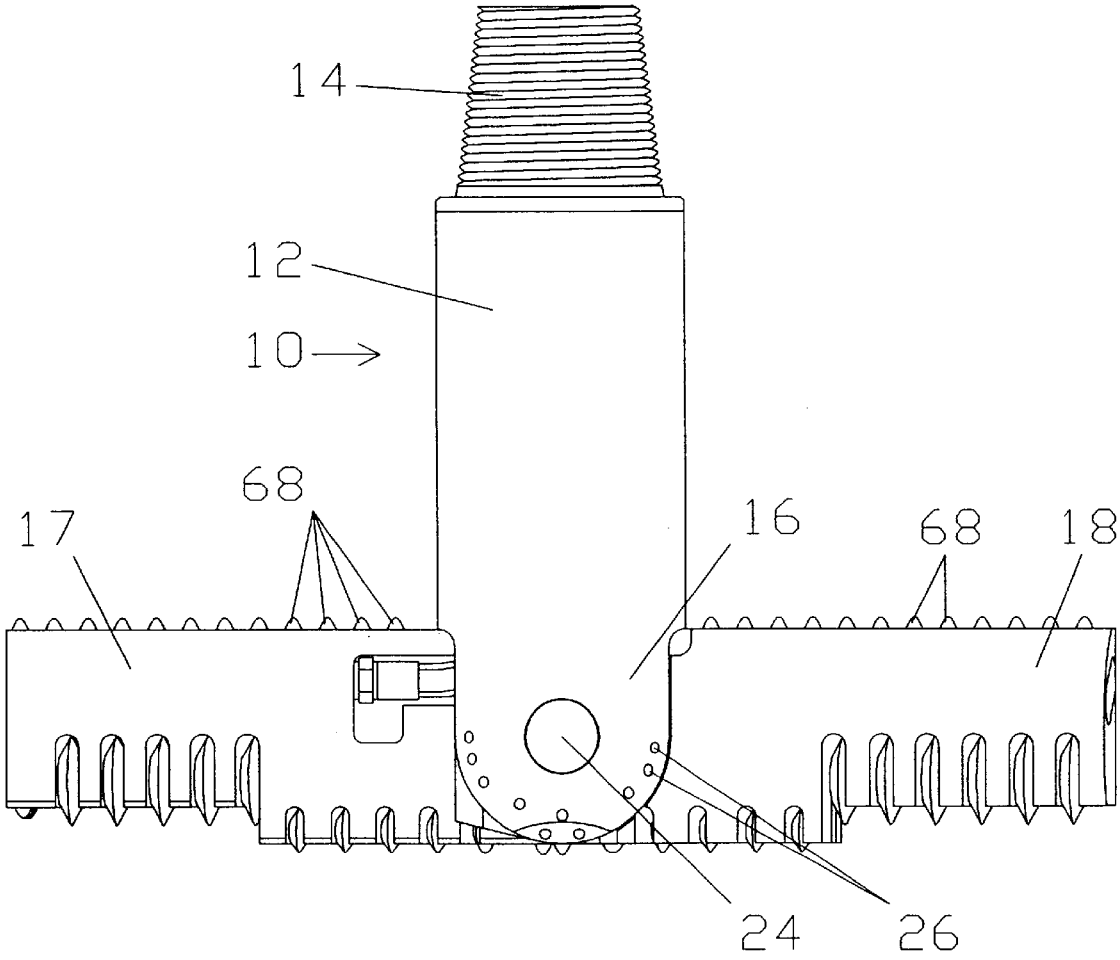
FIG. 1 is an elevational view of a preferred form of drill bit assembly in accordance with the present invention and illustrating the cutter blades of the assembly in their cutting position.
Figure 4:
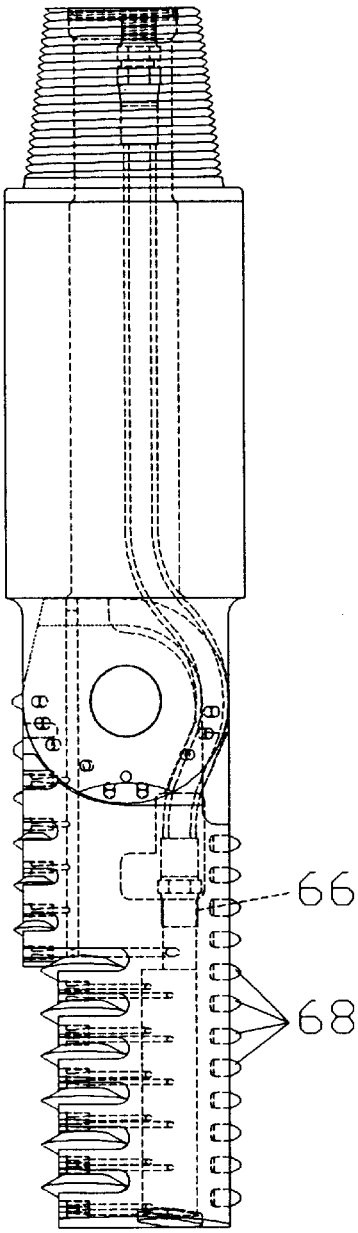
FIG. 4 is an elevational view of the blade shown in FIG. 2 with the blade being shown at rest.
Figure 5:
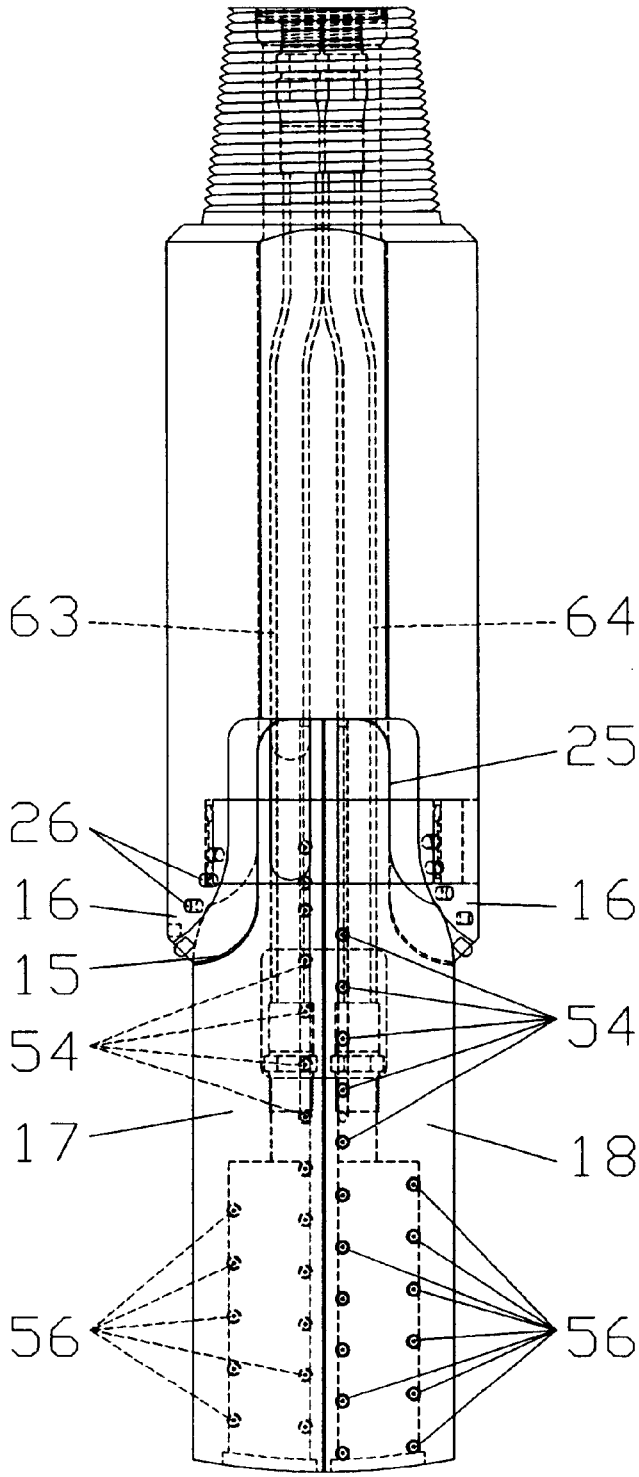
FIG. 5 is an elevational view of the drill bit assembly shown in FIG. 1 but with the blades shown at rest.

Referring to the drawings, there is illustrated in FIGS. 1 to 8 a preferred form of drill bit assembly 10 which is comprised of a sub 12 in the form of a hollow cylindrical body having an upper threaded end 14 and a lower bifurcated pivotal end 16. As best seen from FIGS. 9A to 9D and 10A to 10D, a pair of blades 17 and 18 are each made up of an elongated blade arm 20 tapering into a rounded pivotal end 22 having a transverse opening 23 for insertion of a common pivot pin 24 through aligned openings in the lower pivotal ends 16 of the sub 12. Each blade arm 20 is of generally semi-circular configuration having a flat surface portion 19. Thus the blades 17 and 18 are supported for pivotal movement between a first position extending substantially in a lengthwise direction when at rest and a transverse or mutually perpendicular direction when in operation as illustrated in FIGS. 5 and 1, respectively. The pivotal ends 16 are in the form of ears or extensions of the hollow cylindrical sub body 12 so as to be arcuate in cross-section and have a series of fixed cutting inserts 26 at spaced intervals along their external surface portions.

Each of the blades 17 and 18 has a generally concave surface portion 28 tapering into the pivotal end 22 and which surface portion 28 is complementary to the convex surface portion 15. In turn, the pivotal ends 22 are of a thickness such that when mounted on the pivot shaft 24 will clear the arcuate edges 25 of the pivotal end 16 so that the blade arms are free to swing freely into and away from the mutual perpendicular positions shown in FIG. 1 with their flat surface portions 19 in closely spaced confronting relation to one another.

Each of the blade arms 20 includes radially offset larger and smaller semi-circular body portions 30 and 32, the larger portion 32 extending along the inner radial surface of the arm 20 adjacent to the pivotal end 22. The smaller portion 30 is of approximately the same length as the larger portion 32 and terminates in an outer squared distal end 34 of the arm. In the smaller surface portion 30, a series of first cutter disks 36 are mounted for rotation about individual roller shafts 37 which are fixed in recesses in the undersurface of each of the blade arms 20 and at uniform, axially spaced intervals along the undersurface of each arm adjacent to the flat surfaces 19. As best seen from FIGS. 2 and 3, the axis of rotation for each disk is such as to correspond to the radius of curvature which that disk follows. In other words, the shaft 37 for that disk is perpendicular to the radius of curvature at that point on the undersurface of the arm 20. The individual disks 36 are of a hardened material, such as, tungsten carbide material and have tapered surfaces which terminate in a common cutting edge 38.

The radially inner body portion 32 is provided with relatively small cutter disks 40 which are mounted for rotation about individual shafts 42. The disks 40 are oriented in a manner corresponding to that described with reference to the larger disks 36 so as to follow the circular path of rotation at that radius from the center or pivotal axis 24. The disks 40 are similarly arranged to extend along the undersurface or leading edge of the blade arm but in slightly trailing relation to the larger disks 36, as best seen in FIG. 3.

Figure 2:
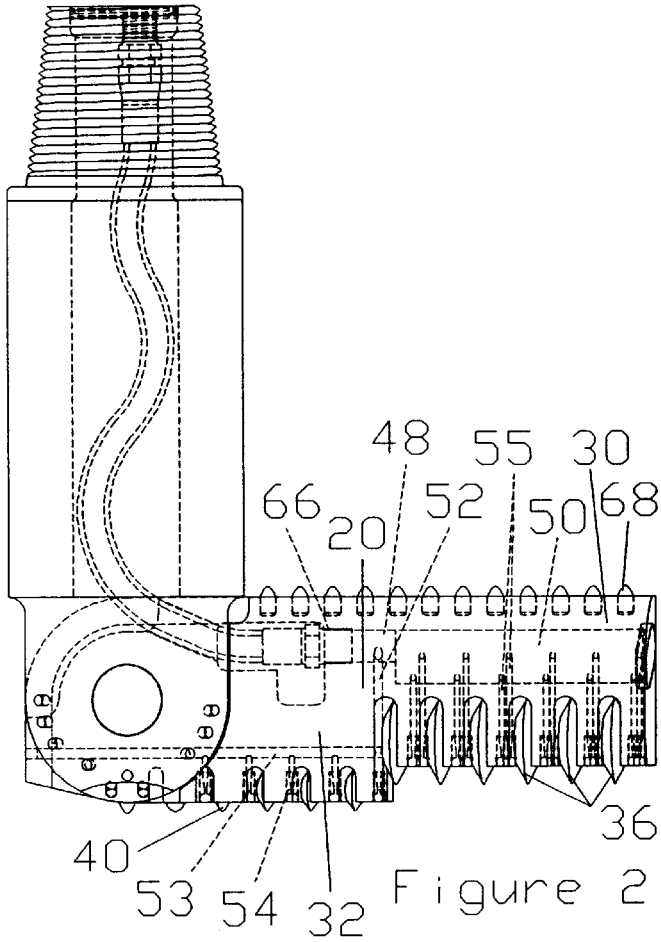
FIG. 2 is an elevational view showing one of the blades including fluid delivery system in the cutting position.
Figure 3:
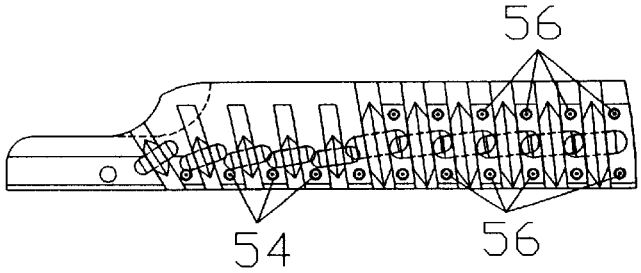
FIG. 3 is a bottom plan view of the blade shown in FIG. 2.
Figure 8:
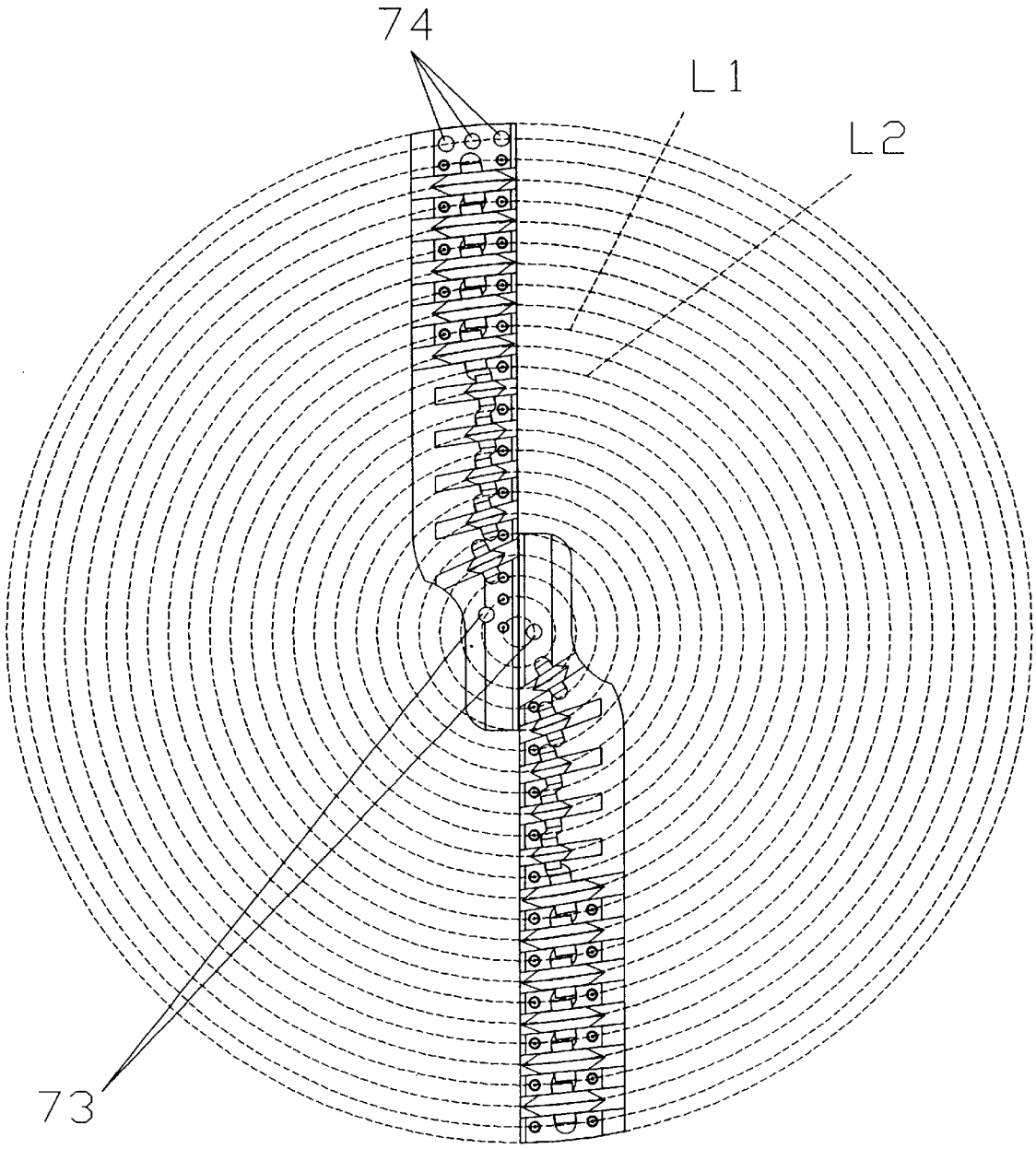
FIG. 8 is a bottom plan view of the preferred form of drill bit assembly and illustrating the kerf lines formed during the earth boring operation.

As shown in FIGS. 2 to 4, each blade arm 20 includes a main fluid delivery passage 48 extending radially of the arm and communicating with an enlarged passage 50 within the arm directly behind the larger cutter disks 36. The fluid passage 48 also communicates with a smaller channel 52 which extends transversely of the passage 48 and communicates with channel 53 extending lengthwise of the blade arm 20 directly behind the smaller disks 40 in the larger portion 32 of the body. A plurality of discharge nozzles or jets 54 extend from the channel 53 through the portion 32 to discharge fluid under pressure from the blade arms at a location in close proximity to the cutter disks 40 so as to form a series of kerf cutting lines $L_1$ as represented in FIG. 8.

Figure 6:
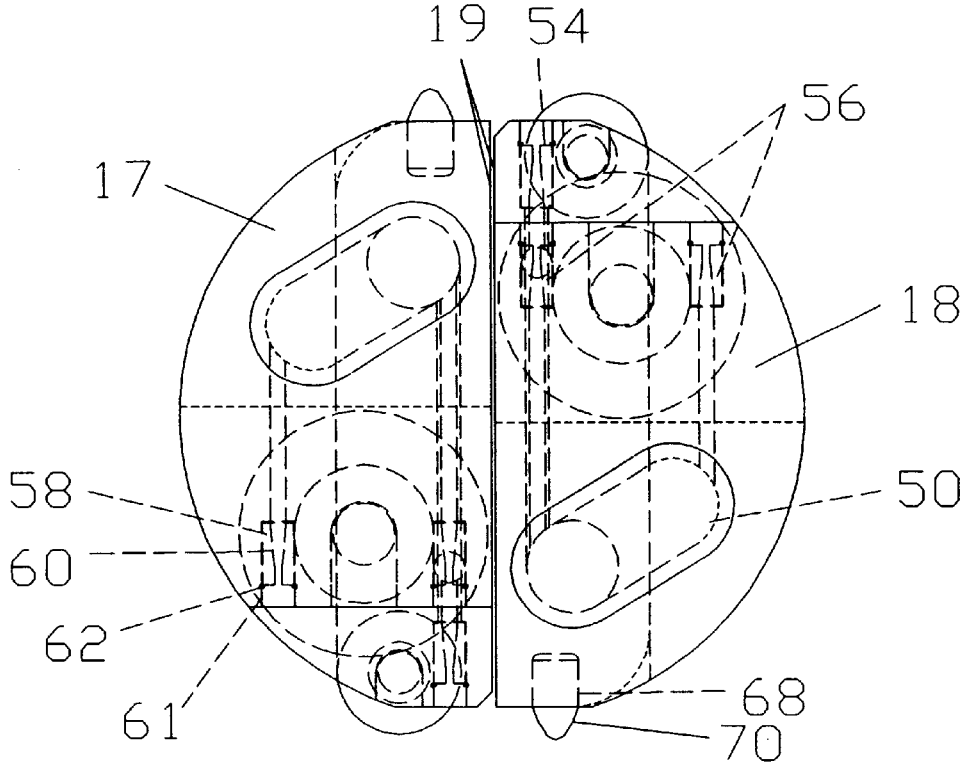
FIG. 6 is an enlarged end view of the preferred drill bit assembly shown in FIG. 5.

The main fluid passage 50 also communicates with dual jet discharge nozzles 56 via a pair of passages 55 in the larger body portion 30 of each blade arm, there being a pair of nozzles 56 which discharge fluid into the formation adjacent to each larger cutter disk 36 fore and aft of the shafts 37 as illustrated. The nozzles 56 form kerf cutting lines as represented at $L_2$ in FIG. 8. As shown in FIG. 6, each of the nozzles 54 and 56 is in the form of a hollow cylindrical body 58 having a venturi-shaped bore 60 which converges towards its discharge end, and the body 58 is mounted within a counterbore 61 and secured therein by a retainer ring 62.

Figure 7:
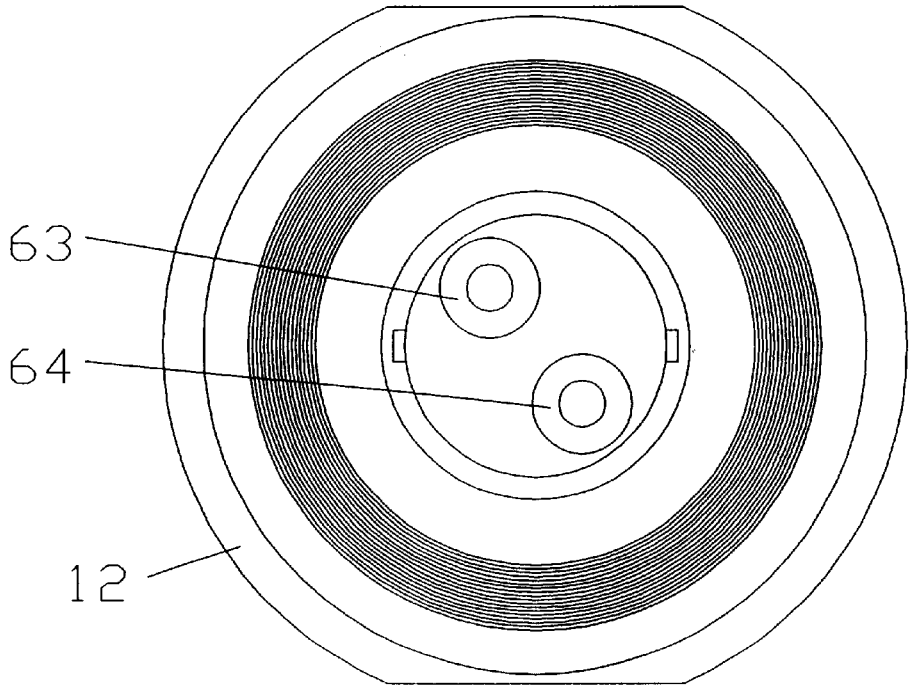
FIG. 7 is an opposite end view to that of FIG. 6.

Having further reference to FIGS. 5 to 7, a pair of flexible fluid delivery hoses 63 and 64 extend downwardly through the hollow body 12 and are threadedly connected as at 66 to the inner radial ends of the channels 48 of each of the blades 17 and 18. The hoses 63, 64 are in communication with fluid pumped through the drill string or casing string, not shown, from which the sub 12 is suspended. In this manner, the delivery hoses 63, 64 will easily bend or flex in following the pivotal movement of the cutter blades during the drilling operation while maintaining a tight seal with the passages 48.

A series of cutting inserts 68 of a hardened cutting material are inserted in circular recesses along the trailing edge of each blade 17 and 18. Each insert 68 is of generally elongated cylindrical configuration having a tapered end 70 which protrudes from the trailing edge in order to cut into the formation when the blades 17 and 18 are rotated. The cutting inserts 68 are most useful in the event of formation hole collapse, hole sloughing or hole swelling. Under continued rotation and/or frictional force engagement and/or fluid discharge force, the blades 17 and 18 will gradually swing or pivot outwardly into their mutually perpendicular position as shown in FIG. 1. At that point, the cutter disks 36 and 40 will gradually move into cutting engagement with the formation. Along with the cutting inserts 26 on the bifurcated end surfaces 16 of the sub 12, cutting inserts 73 may be positioned along at least a limited portion of the leading edge of each inner blade portion 32, and cutting inserts 74 are positioned at outer distal ends of the blades 17 and 18.

Figure 9A:
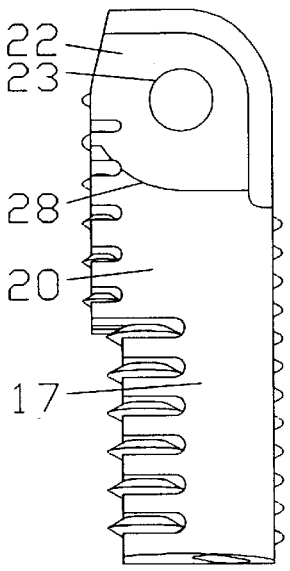
FIGS. 9A to 9D are elevational views of the front, side, rear and opposite side respectively of one of the cutter blades.
Figure 9B:
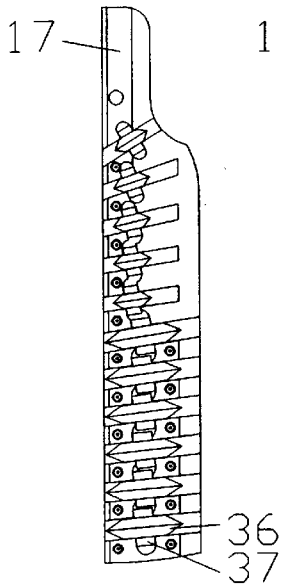
Figure 9C:
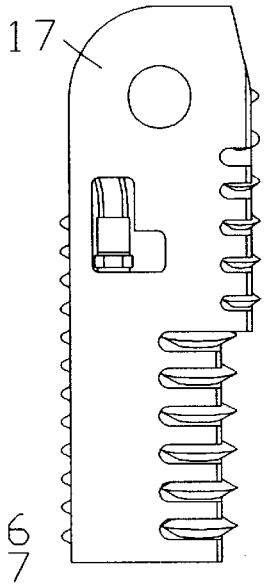
Figure 9D:
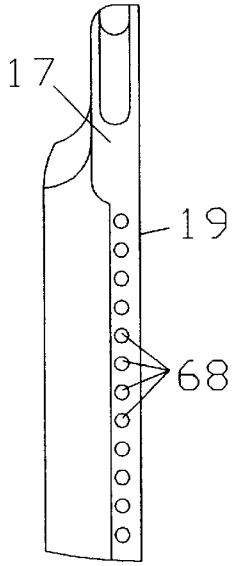
Figure 10A:
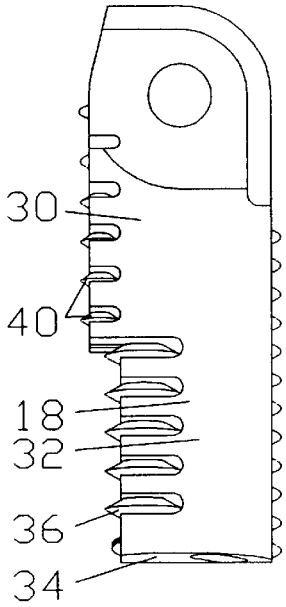
FIGS. 10A to 10D are elevational views of the front, side, rear and opposite side respectively of another of said cutter blades.
Figure 10B:
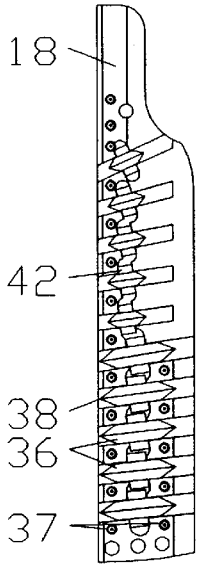
Figure 10C:
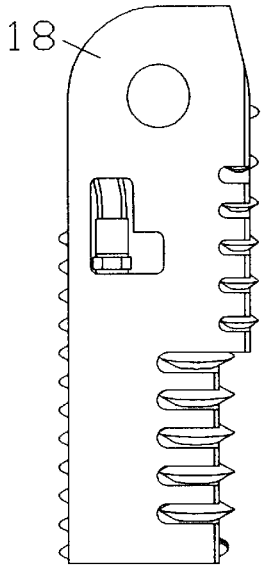
Figure 10D:
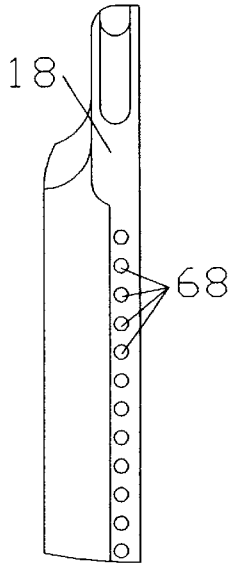

As seen from a comparison of FIGS. 9A to 9C with 10A to 10C, the cutter disks 36 and 40 on one blade arm 17 are offset with respect to the cutter disks 36 and 40 on the other blade arm 18. Correspondingly, the nozzles 54 and 56 on the one blade arm 17 are offset or staggered with respect to the nozzles 54 and 56 on the other blade arm 18. The primary function of the nozzles is to form the kerf lines $L_1$ and $L_2$ as illustrated in dashed form in FIG. 8 as described. In turn, the cutter disks 36 and 40 are operative to break up the rock between the kerf lines $L_1$ and $L_2$ and therefore are aligned between the nozzles 54 and 56 of their respective blade arms.

In operation, the drill bit assembly 10 is assembled by threading the end 14 into the lower end of a conventional drill, casing or tubing string. The drill bit assembly is then rotated as it is lowered into position at the desired location for earth boring into the formation so as to cause the blades 17 and 18 to swing outwardly into the open position shown in FIG. 1. Fluid is supplied under pressure through the hoses 63 and 64 and is discharged in the form of high velocity jet streams through the nozzles 54 and 56. The delivery of fluid under a high degree of force through the blades 17 and 18 will assist in causing the blades to gradually swing outwardly into the cutting position shown in FIG. 1 as well as to cooperate with the cutter disks 36 and 40 to cut through the formation in forming the desired size bore or hole. The fluid which is pumped through the nozzles or jets in forming the kerf cutting lines $L_1$ and $L_2$ will further assist in removing the cuttings upwardly between the drill string and face of the bore to the surface.

The smaller sized disks 40 are employed along the larger surface portion 32 at the inner radial end of the arm 20 as a result of space limitations on the size of disks that can be employed adjacent to the lower pivotal end 16. The function of the larger disk is to provide an increased cutting surface area in traversing greater distances at the outer distal ends of the blades 17 and 18. It will be apparent that fluid channels other than the hoses 63 and 64 can be employed to direct fluid under pressure into each of the blades 17 and 18. However, the hoses 63 and 64 offer a more secure and durable fluid delivery passage while avoiding the necessity of seals between moving surfaces. The larger cutting disks 36 employed along the smaller surface portion 30 may be varied in size, and it is not particularly critical whether the large disks 36 are in trailing relation to the smaller disks 40 and is more a matter of dimensioning the disks 36 and 40 to best fit into the body portions 30 and 32 and leave adequate space for the fluid delivery passages.

DETAILED DESCRIPTION OF MODIFIED FORMS OF INVENTION

Figure 11:
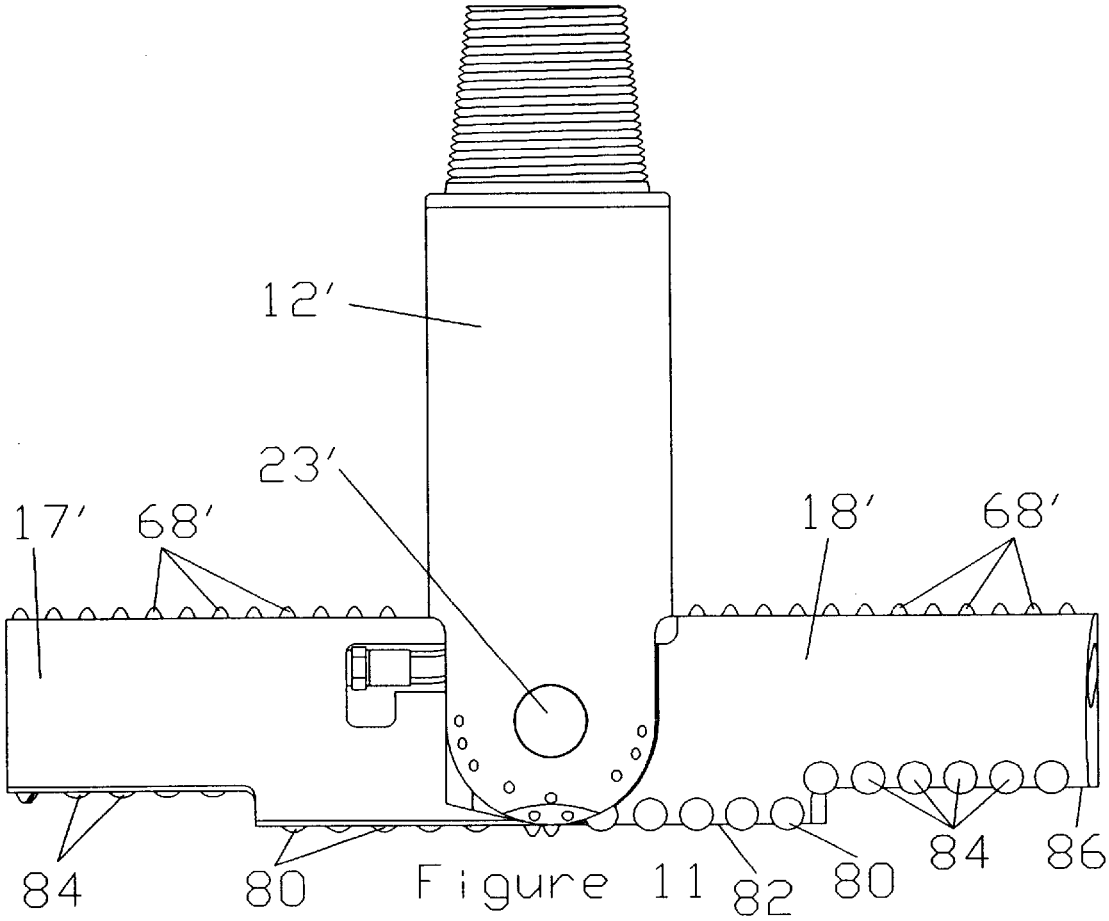
FIG. 11 is an elevational view of a modified form of drill bit assembly provided with a series of stationary cutters and cutting inserts thereon.
Figure 11A:
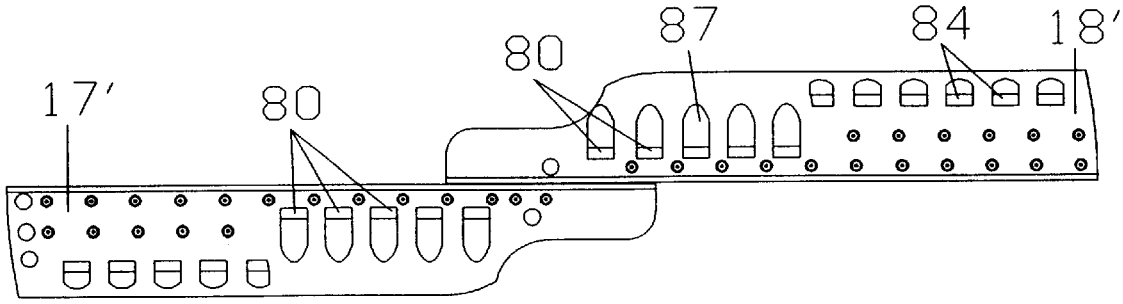
FIG. 11A is a bottom plan view of the cutter blades shown in the modified form of FIG. 11.

Modified forms of invention are illustrated in FIGS. 11, 11A and 12, 12A in which like parts to those in the preferred form are correspondingly enumerated. Referring to FIGS. 11, 11A, in place of rotatable cutting disks 36 and 40, stationary cylindrical cutting elements 80 are inserted at radially spaced intervals along radially inner leading edge 82 of each cutter blade 17' and 18'. Specifically, the cutting elements 80 have their centers on axes extending normal to the leading edge 82 and parallel to that of the pivot 23' of the cutting blades. Similarly, cylindrical stationary cutting inserts 84 are disposed in outer offset leading edge portion 86 at radially spaced intervals with their axes aligned with those of the elements 80. Both with respect to the elements 80 and 84, the greater circumference of each is embedded in bores 87 in the body of the cutting blades 17' and 18' so that only a limited circumferential portion projects beyond the leading edge 82 or 86. Additional cutting inserts 68' corresponding to those of the preferred form are arranged in radially spaced relation along the trailing edges of the blades 17' and 18'.

Figure 12:
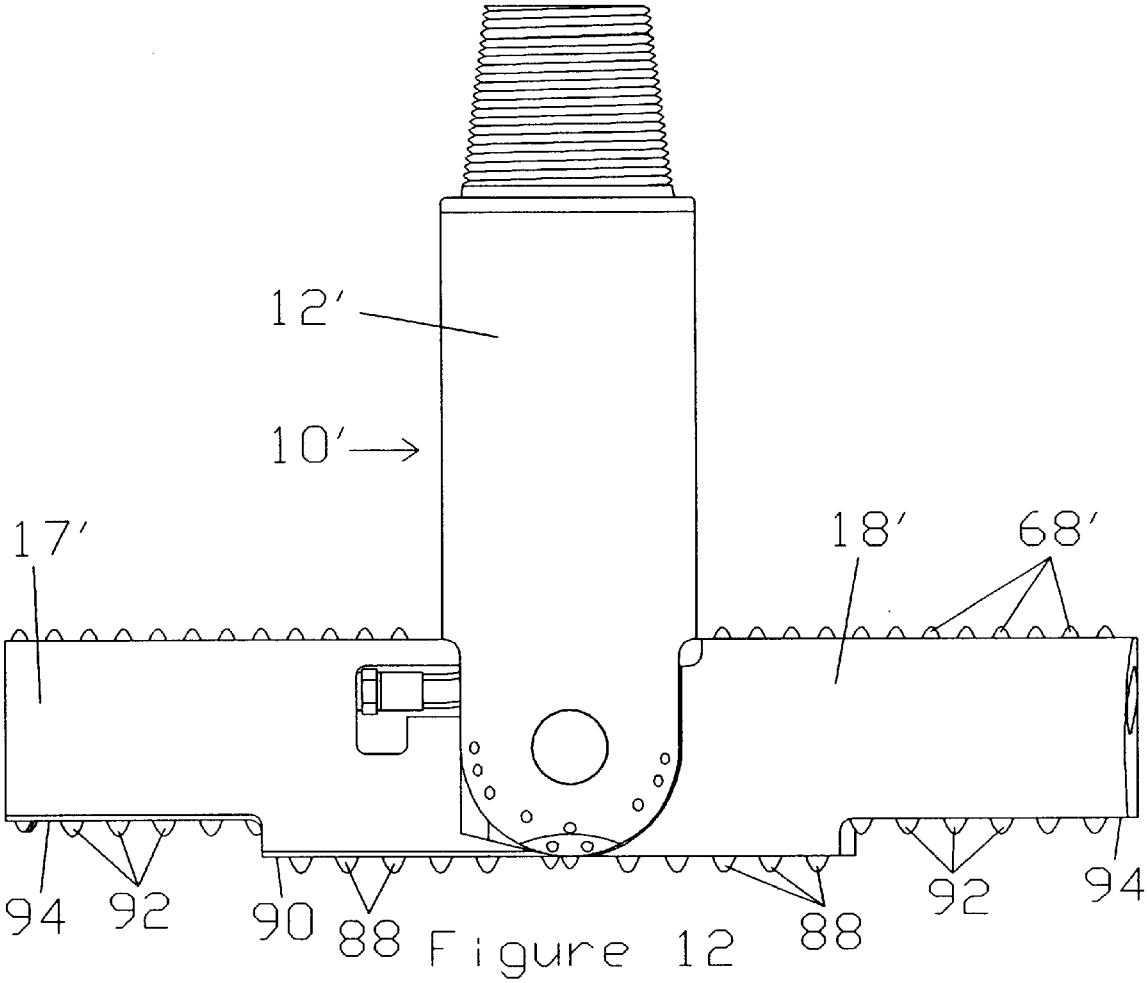
FIG. 12 is an elevational view of another modified form of invention provided with a series of cutting inserts thereon.
Figure 12A:
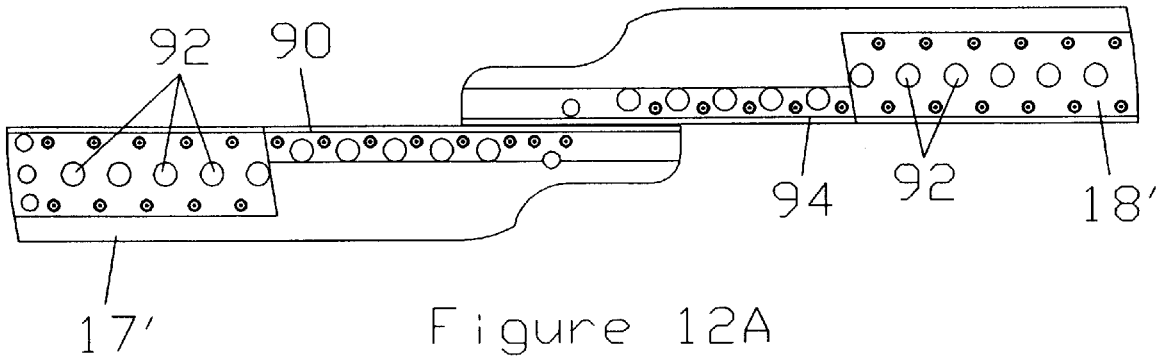
FIG. 12A is a bottom plan view of the modified form of cutter blades shown in FIG. 12.

Still another modified form of drill bit is illustrated in FIG. 12 wherein stationary cutting elements 88 are disposed in radially spaced relation along radially inner leading edge portions 90 of each of the cutter blades 17' and 18' and are dimensioned and mounted in the body of the blades 17' and 18' in the same manner as described with reference to the cutting inserts 68 of the preferred form. The same applies to cutting inserts 92 that are arranged in radially spaced relation to one another along the radially outer leading edge portions 94.

The selection of cutting blades as described in the preferred and modified forms is dictated primarily by the hardness of the formation and drilling speed. Typically, the cutting elements described in the modified forms would be better suited for softer formations than the rotatable cutter disks 36 and 40 of the preferred form and will cooperate in the same manner with the fluid discharge jets in advancing through the formation.

It is therefore to be understood that while a preferred form of invention is herein set forth and described the above and other modifications and changes may be made therein without departing from the spirit and scope of the invention as defined by the appended claims and reasonable equivalents thereof.

I claim:

1. A drill bit assembly adapted to be mounted on a drill string for earth boring operations in a subsurface formation comprising:

a body connected to said drill string;

a plurality of elongated cutter blades pivotally secured to a lower end of said body, said lower end including cutting elements thereon;

said blades including cutting elements spaced along a leading edge of each of said blades adapted to move into cutting engagement; and fluid delivery means communicating with a fluid delivery passage in each said blade, and a plurality of fluid discharge nozzles communicating with said passage in each said blade.

2. A drill bit assembly according to claim 1 wherein said fluid discharge nozzles are disposed along said leading edges.

3. A drill bit assembly according to claim 1 wherein said cutting elements are of increased size in an outward radial direction along each of said blades.

4. A drill bit assembly according to claim 3 wherein said cutting elements are of increased diameter in an outward radial direction along each of said blades.

5. A drill bit assembly according to claim 1 wherein said fluid discharge nozzles are positioned between said cutting elements.

6. A drill bit assembly according to claim 1 wherein said fluid delivery means includes a flexible hose for delivering fluid under pressure through said body into said passage in each said blade.

7. A drill bit assembly according to claim 1 wherein each of said blades includes a plurality of radially spaced cutting elements along a trailing edge thereof.

8. A drill bit assembly according to claim 3 wherein a plurality of smaller cutting elements are mounted in each said blade at radially spaced intervals along a radially inner portion of said blade and a plurality of larger cutting elements are mounted at radially spaced intervals in an outer radial portion of said blade.

9. A drill bit assembly according to claim 8 wherein said fluid delivery passage in each said blade communicates with a first channel for delivering fluid under pressure to said fluid discharge nozzles adjacent to said radially inner cutting elements and communicates with a plurality of channels for delivery of fluid under pressure to said fluid discharge nozzles adjacent to said radially outer cutting elements.

10. A drill bit assembly according to claim 9 wherein a pair of said fluid discharge nozzles are mounted in fore and aft relation to one another between adjacent of said radially outer cutting elements.

11. A drill bit assembly according to claim 1 wherein a pair of said blades are pivotally secured to said body, each of said blades being of generally semi-circular cross-sectional configuration, said blades being movable in opposite directions to one another from a position extending substantially in a direction parallel to the rotational axis of said drill string and a position extending substantially in opposite perpendicular directions to the rotational axis of said drill string in response to centrifugal force from rotation and/or frictional force from engagement with formation and/or delivery of fluid under pressure through said fluid discharge nozzles.

12. A drill bit assembly adapted to be mounted on a drill string for earth boring operations comprising:

a sub connected to a lower end of said drill string;

a pair of elongated cutter blades pivotally secured to a lower end of said sub, said lower end being bifurcated and including cutting elements thereon;

each of said blades being of generally semi-circular cross-sectional configuration, said blades having flat surface portions in confronting relation to one another;

a pivot shaft mounting said blades between said bifurcated lower end portions of said sub for pivotal movement between extension in a common axial direction and extension in opposite perpendicular directions to one another;

a plurality of cutting elements extending along leading and trailing edges of said blades; and fluid delivery means extending through said sub into communication with a fluid delivery passage in each of said blades, and a plurality of fluid discharge nozzles extending through said leading edges of said blades perpendicular to said flat surface portions.

13. A drill bit assembly according to claim 12 wherein said blades include rotatable cutter elements along a leading edge thereof.

14. A drill bit assembly according to claim 13 wherein said cutter elements are disposed in offset portions on said blades.

15. A drill bit assembly according to claim 14 wherein said fluid discharge nozzles extend between said cutter elements.

16. A drill bit assembly according to claim 13 wherein said cutter elements are of increased size in an outward radial direction along each of said blades.

17. A drill bit assembly according to claim 16 wherein said cutter elements are disks of increased diameter in an outward radial direction along each of said blades.

18. A drill bit assembly according to claim 17 wherein said fluid delivery means includes a flexible hose for delivering fluid under pressure through said sub into said passage in each said blade.

19. A drill bit assembly according to claim 12 wherein each of said blades includes a plurality of radially spaced cutter elements along a trailing edge thereof.

20. A drill bit assembly according to claim 17 wherein a plurality of smaller cutter disks are mounted in each said blade at radially spaced intervals along a radially inner portion of said blade and a plurality of larger cutter disks are mounted at radially spaced intervals in an outer radial portion of said blade.

21. A drill bit assembly according to claim 20 wherein said fluid delivery passage in each said blade communicates with a first channel for delivering fluid under pressure to said fluid discharge nozzles adjacent to said radially inner cutter elements and communicates with a second channel for delivery of fluid under pressure to said fluid discharge nozzles adjacent to said radially outer cutter elements.

22. A drill bit assembly according to claim 21 wherein pairs of said fluid discharge nozzles are mounted in fore and aft relation to one another between adjacent of said radially outer cutter disks.

23. In a drill bit assembly for performing earth boring operations in a subsurface formation having a sub connected to a lower end of a drill string and a plurality of elongated cutter blades pivotally secured to a lower end of said sub, a plurality of cutter elements disposed along a leading edge of each said blade and fluid delivery passages for delivery of fluid under pressure to a plurality of fluid discharge jets, the method comprising:

discharging a high velocity stream of fluid through said jets in at least one of a pair of said blades whereby to form a series of kerf lines in concentric circles;

placing said cutter elements on at least one other of said blades to break up the formation of material between the kerf lines formed by the jet streams through the nozzles; and orienting said cutter elements to follow said kerf lines to assist in breaking up the formation between the kerf lines.

24. The method according to claim 23 wherein said fluid discharge jets are disposed along said formation-engaging surfaces.

25. The method according to claim 23 wherein said cutter elements are of increased size in an outward radial direction along each of said blades.

26. The method according to claim 25 wherein said cutter elements are of increased diameter in an outward radial direction along each of said blades.

27. The method according to claim 23 wherein said fluid discharge nozzles are positioned between said cutter elements.

28. The method according to claim 23 wherein said fluid delivery passage in each said blade communicates with a first channel for delivering fluid under pressure to said fluid discharge nozzles adjacent to said radially inner cutter elements and communicates with a second channel for delivery of fluid under pressure to said fluid discharge nozzles adjacent to said radially outer cutter elements.

29. The method according to claim 23 including the step of moving said blades in opposite directions to one another from a position extending substantially in a direction parallel to the rotational axis of said drill string and a position extending substantially in opposite perpendicular directions to the rotational axis of said drill string in response to centrifugal force from rotation and/or functional force from engagement with formation and/or delivery of fluid under pressure through fluid discharge jets.

* * * * *